US008957659B2

(12) United States Patent
Fujimura et al.

(10) Patent No.: US 8,957,659 B2
(45) Date of Patent: Feb. 17, 2015

(54) VOLTAGE REGULATOR

(71) Applicant: Seiko Instruments Inc., Chiba-shi, Chiba (JP)

(72) Inventors: Manabu Fujimura, Chiba (JP); Takashi Imura, Chiba (JP); Yuji Kobayashi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 199 days.

(21) Appl. No.: 13/779,197

(22) Filed: Feb. 27, 2013

(65) Prior Publication Data

US 2013/0234687 A1 Sep. 12, 2013

(30) Foreign Application Priority Data

Mar. 8, 2012 (JP) ..... 2012-051841

(51) Int. Cl.
*G05F 1/40* (2006.01)
*G05F 1/10* (2006.01)

(52) U.S. Cl.
CPC ..... *G05F 1/10* (2013.01)
USPC ..... 323/285

(58) Field of Classification Search
USPC ..... 323/269, 271–27, 282–288, 300, 312; 327/538, 543
See application file for complete search history.

(56) References Cited

U.S. PATENT DOCUMENTS

| | | | | |
|---|---|---|---|---|
| 6,420,857 | B2 * | 7/2002 | Fukui | 323/280 |
| 6,727,669 | B2 * | 4/2004 | Suzuki et al. | 318/139 |
| 7,068,018 | B2 * | 6/2006 | Kanakubo | 323/274 |
| 8,212,545 | B2 * | 7/2012 | Imura | 323/313 |
| 2011/0074508 | A1 | 3/2011 | Imura | |

FOREIGN PATENT DOCUMENTS

JP 2011-096210 A 5/2011

* cited by examiner

*Primary Examiner* — Rajnikant Patel
(74) *Attorney, Agent, or Firm* — Brinks Gilson & Lione

(57) ABSTRACT

Provided is a voltage regulator having improved transient response characteristics even when a load current is switched from a light load to a heavy load. The voltage regulator includes, to a gate of a detection transistor constituting an output current detection circuit: a resistive element for interrupting the gate of the detection transistor from an output terminal of a differential amplifier circuit in an AC manner; and a capacitive element connected to an output terminal of the voltage regulator in an AC manner.

6 Claims, 6 Drawing Sheets

VOLTAGE REGULATOR

RELATED APPLICATIONS

This application claims priority under 35 U.S.C. §119 to Japanese Patent Application No. 2012-051841 filed on Mar. 8, 2012, the entire content of which is hereby incorporated by reference.

BACKGROUND OF THE INVENTION

1. Field of the Invention

The present invention relates to a voltage regulator, and more specifically, to an improvement of transient response characteristics when an output current fluctuates.

2. Description of the Related Art

FIG. 6 illustrates a conventional voltage regulator including an output current detection circuit. A differential amplifier circuit 104 compares an output voltage of a reference voltage circuit 103 and an output voltage of a voltage dividing circuit 106 to each other and controls a gate-source voltage of an output transistor 105, to thereby obtain a desired voltage at an output terminal 102. An output current detection circuit 107 includes a detection transistor 112, an output current monitoring circuit 113, and a control circuit 114.

When the output terminal 102 of the voltage regulator decreases because of an increased load current, the differential amplifier circuit 104 operates so as to increase the gate-source voltage of the output transistor 105. The output transistor 105 and the detection transistor 112 are transistors having the same characteristics but different K values, and are current-mirror connected to each other. Therefore, the detection transistor 112 allows a current Im corresponding to a load current of the output voltage 102 to flow. The output current monitoring circuit 113 converts the current Im flowing through the detection transistor 112 into a voltage, and outputs the voltage. In response to the voltage output from the output current monitoring circuit 113, the control circuit 114 generates and outputs a control signal. In response to the control signal output from the control circuit 114, the differential amplifier circuit 104 increases a bias current.

As described above, in the conventional voltage regulator, the output current detection circuit controls the bias current of the differential amplifier circuit 104 in accordance with the load current, and hence transient response characteristics are improved (see, for example, Japanese Patent Application Laid-open No. 2011-96210).

However, the conventional voltage regulator including the output current detection circuit detects the load current by an output signal of the differential amplifier circuit 104, thereby controlling the bias current of the differential amplifier circuit 104. Thus, it has been difficult to swiftly respond to a decrease in output voltage. In other words, there has been a problem in that, when the load current is switched from a light load to a heavy load, the bias current of the differential amplifier circuit 104 is reduced, and hence the transient response characteristics of the differential amplifier circuit 104 at the time of detecting the decrease in output voltage are poor.

SUMMARY OF THE INVENTION

In order to solve the above-mentioned problem, the present invention provides a voltage regulator including a resistive element, which is connected between a gate terminal of an output transistor and a gate terminal of a detection transistor, and a capacitive element, which is connected between an output terminal of the voltage regulator and the gate terminal of the detection transistor.

According to the voltage regulator of the present invention, the detection transistor swiftly allows a current to flow in response to a decrease in output voltage caused by an increased load current. Thus, an output current detection circuit can increase a bias current of a differential amplifier circuit at high speed. In this way, the decrease in output voltage caused by an increased load can be suppressed, and hence transient response characteristics can be improved.

DETAILED DESCRIPTION OF THE PREFERRED EMBODIMENTS

First Embodiment

Figure 1:
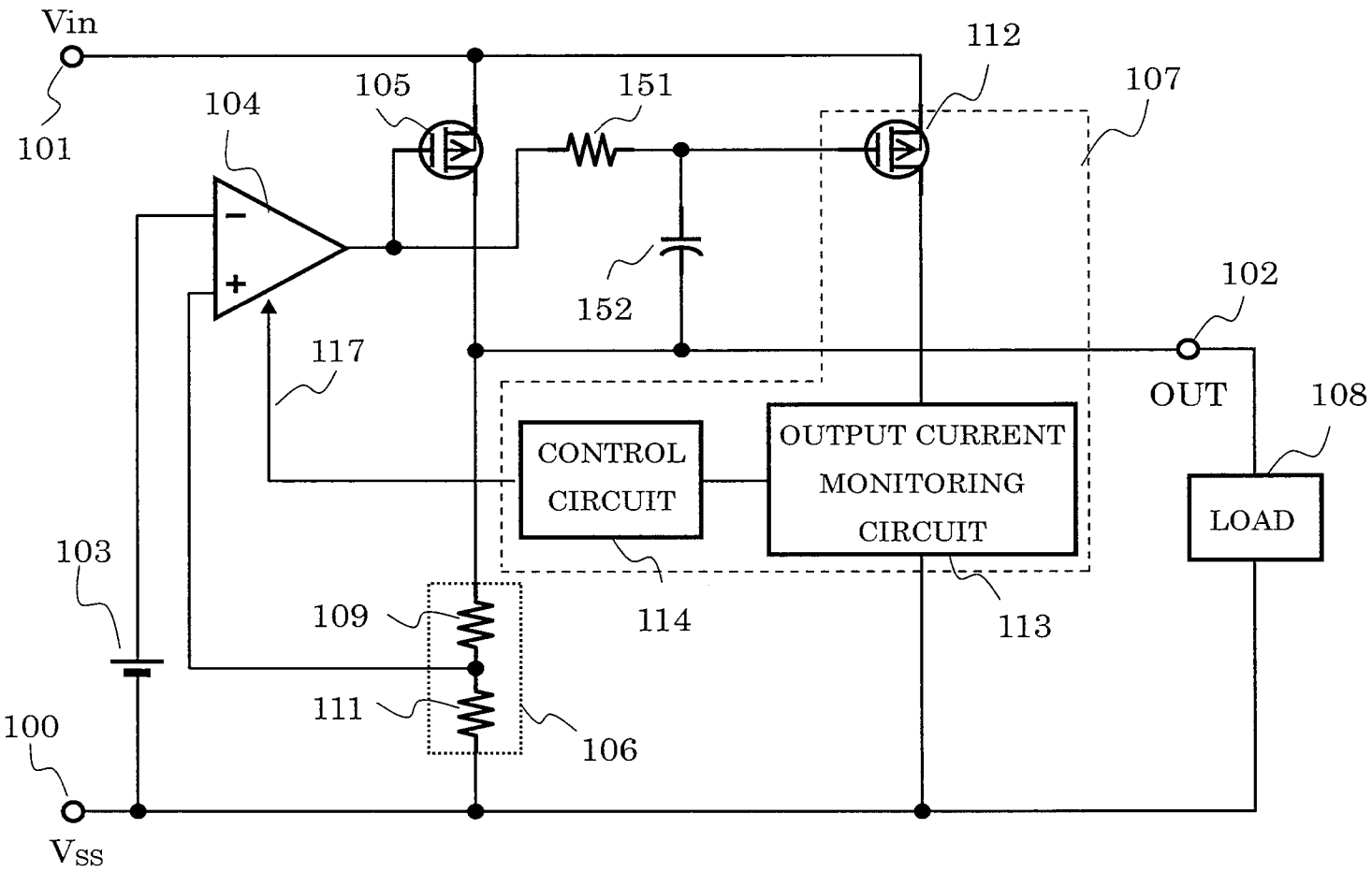
FIG. 1 is a circuit diagram illustrating a voltage regulator including an output current detection circuit according to a first embodiment of the present invention.

FIG. 1 is a circuit diagram illustrating a voltage regulator including an output current detection circuit according to a first embodiment of the present invention. The voltage regulator in this embodiment includes a reference voltage circuit 103, a differential amplifier circuit 104, an output transistor 105, a voltage dividing circuit 106, an output current detection circuit 107, a resistor 151, and a capacitor 152. The output current detection circuit 107 includes a detection transistor 112, an output current monitoring circuit 113, and a control circuit 114.

Next, connections of the circuit components of the voltage regulator in this embodiment are described.

The reference voltage circuit 103 has an output terminal connected to an inverting input terminal of the differential amplifier circuit 104. The voltage dividing circuit 106 is provided between an output terminal 102 and a Vss terminal 100, and has an output terminal connected to a non-inverting input terminal of the differential amplifier circuit 104. The differential amplifier circuit 104 has an output terminal connected to a gate of the output transistor 105. The resistor 151 is provided between the output terminal of the differential amplifier circuit 104 and a gate of the detection transistor 112. The capacitor 152 is provided between the gate of the detection transistor 112 and the output terminal 102. The output transistor 105 has a source connected to a Vin terminal and a drain connected to the output terminal 102. The detection transistor 112 has a source connected to the Vin terminal and a drain connected to the output current monitoring circuit 113. The output current monitoring circuit 113 has an output terminal connected to the control circuit 114. The control circuit 114 has an output terminal connected to an operating current control terminal of the differential amplifier circuit 104.

Next, the operation of the voltage regulator in this embodiment is described.

The gate of the output transistor 105 is separated from the output terminal of the differential amplifier circuit 104 in an AC manner by the resistor 151, and hence the output transistor 105 is coupled to the output terminal 102 in an AC manner via capacitive coupling of the capacitor 152.

When a load 108 fluctuates from a light load to a heavy load, a current flowing from the output terminal 102 to the load 108 increases to decrease a voltage of the output terminal 102. In this case, the gate of the detection transistor 112 can receive the decrease in output voltage of the output terminal 102 due to the action of the resistor 151 and the capacitor 152. Therefore, without waiting for control of a gate-source voltage of the output transistor 105 performed by the differential amplifier circuit 104, a current is allowed to flow through the output current monitoring circuit 113 by the detection transistor 112. As a result, a bias current of the differential amplifier circuit 104 can be increased via the control circuit 114. After that, the detection transistor 112 supplies a current to the output current monitoring circuit 113 based on the voltage used for the differential amplifier circuit 104 to control the output transistor 105 in accordance with the output voltage of the voltage dividing circuit 106. As a result, a bias current of the differential amplifier circuit 104 corresponding to the load 108 is allowed to flow.

As described above, the voltage regulator in this embodiment controls the gate of the detection transistor 112 in response to the fluctuation in output voltage of the output terminal 102, thereby being capable of controlling the bias current of the differential amplifier circuit 104 swiftly in response to the fluctuation in output current. Thus, the transient response characteristics can be improved.

Figure 2:
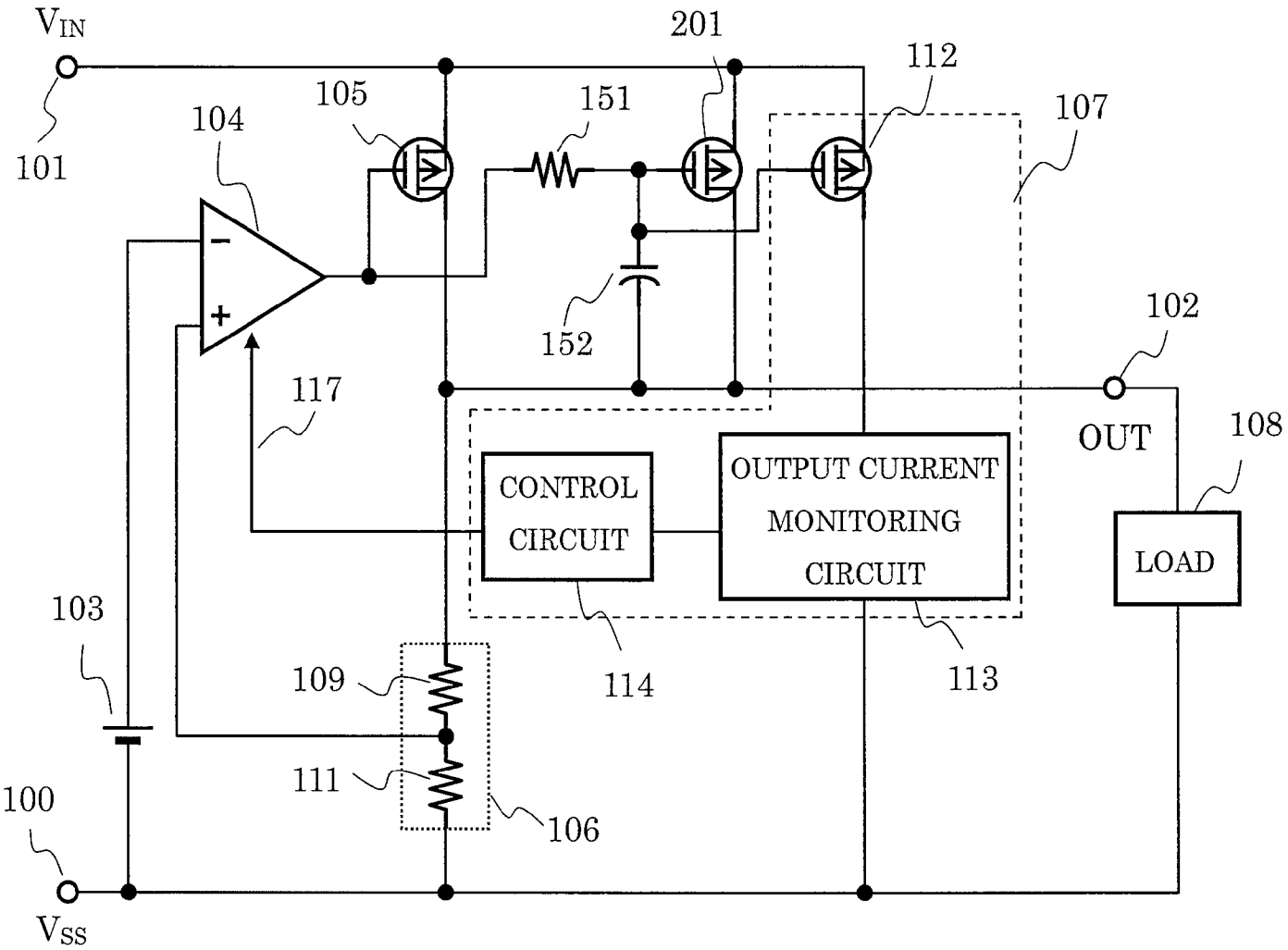
FIG. 2 is a circuit diagram illustrating another example of the voltage regulator including the output current detection circuit according to the first embodiment of the present invention.

Note that, as illustrated in FIG. 2, a pre-driver 201 which is current-mirror connected to the detection transistor 112 may be added in parallel to the output transistor 105.

With this configuration, when the output current fluctuates from a light load to a heavy load, a gate-source voltage of the pre-driver 201 becomes larger at the time of the decrease in output because of capacitive coupling of the capacitor 152. Thus, an output current can be supplied from the pre-driver. Therefore, the voltage regulator operates so as to pull up the output voltage 102 by the current supplied from the pre-driver 201 to the output. Thus, the transient response characteristics can be improved more.

Second Embodiment

Figure 3:
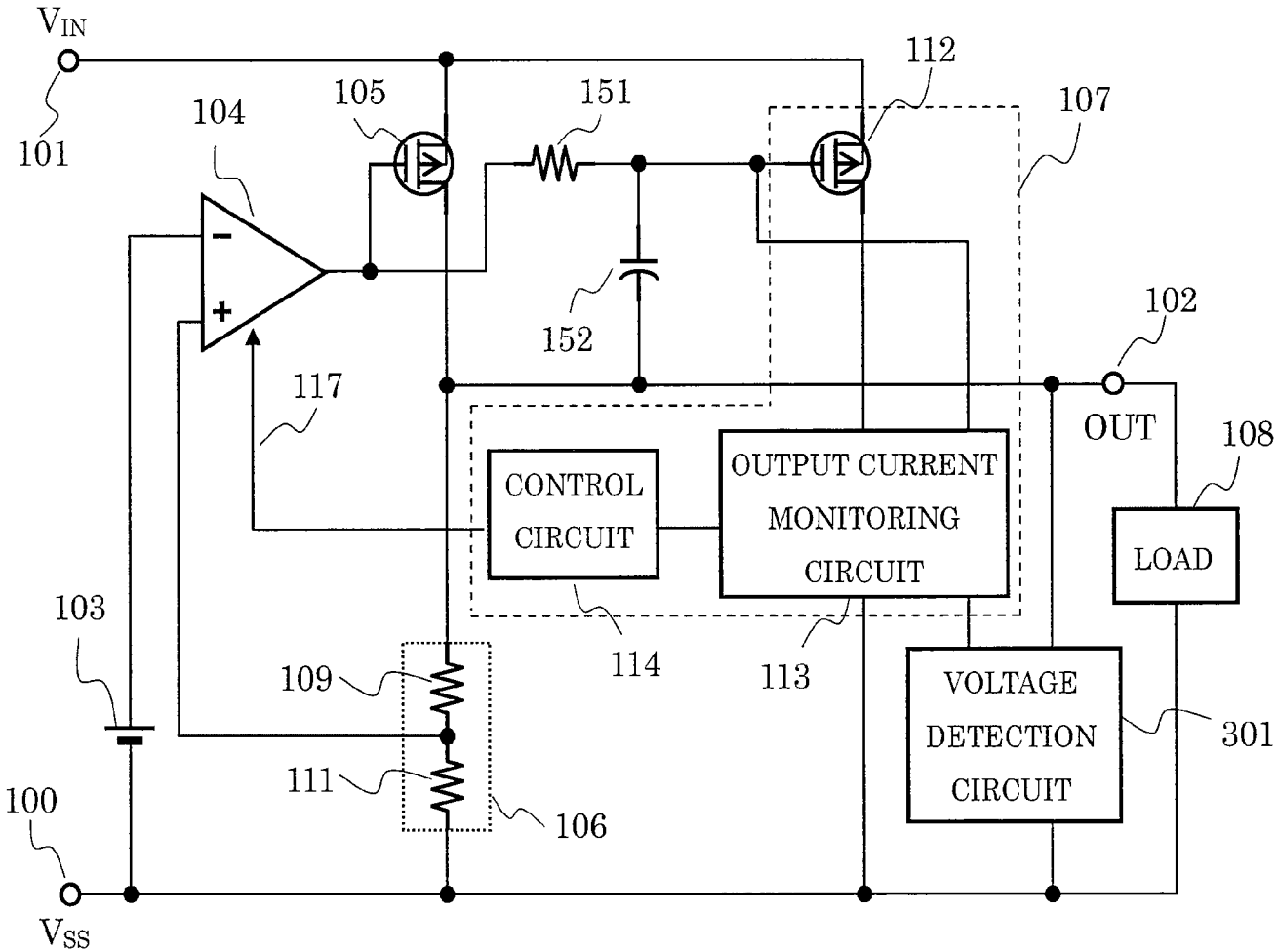
FIG. 3 is a circuit diagram illustrating a voltage regulator including an output current detection circuit according to a second embodiment of the present invention.

FIG. 3 is a circuit diagram illustrating a voltage regulator including an output current detection circuit according to a second embodiment of the present invention. The voltage regulator in this embodiment is obtained by adding a voltage detection circuit 301 to the circuit in the first embodiment. The voltage detection circuit 301 is provided between the output terminal 102 and the Vss terminal 100, and has an output terminal connected to the gate of the detection transistor 112.

Next, the operation of the voltage regulator in the second embodiment is described.

When a load 108 fluctuates from a light load to a heavy load, in response to the fluctuation in output voltage of the output terminal 102, the voltage detection circuit 301 outputs a voltage and a current for directly pulling down a gate voltage of the detection transistor 112. Therefore, a current is allowed to flow through the output current monitoring circuit 113 by the detection transistor 112. As a result, the bias current of the differential amplifier circuit 104 can be increased via the control circuit 114. In this way, the bias current of the differential amplifier circuit 104 can be increased faster than in the first embodiment, and hence the transient response characteristics can be improved more.

In this case, the voltage detection circuit 301 only needs to operate so that the output terminal may be a voltage of the Vss terminal when the decrease in voltage of the output terminal 102 is detected. For example, the voltage detection circuit 301 may be formed of a circuit as illustrated in FIG. 5.

Figure 5:
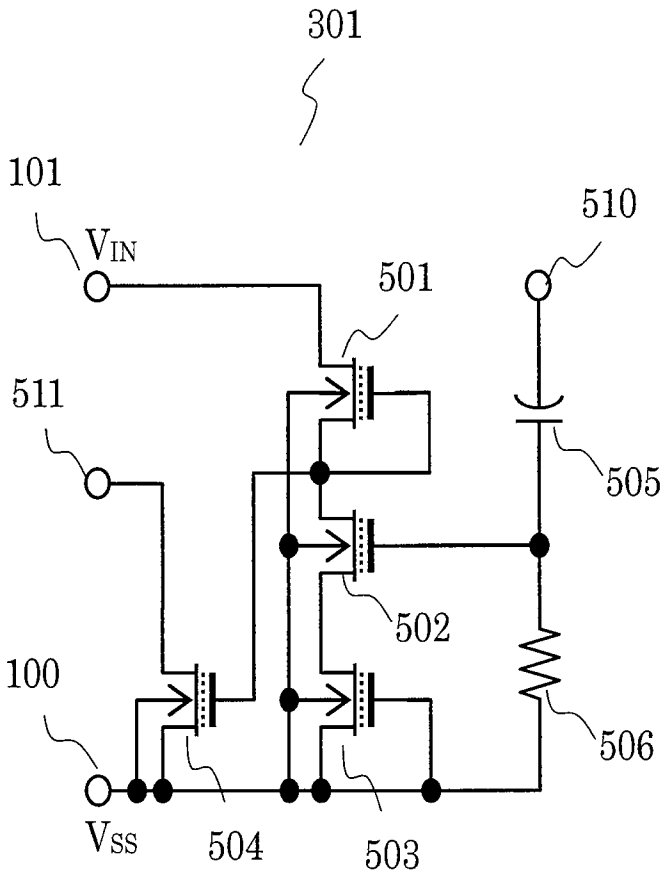
FIG. 5 is a circuit diagram illustrating an example of a voltage detection circuit according to the second and third embodiments of the present invention.
Figure 6:
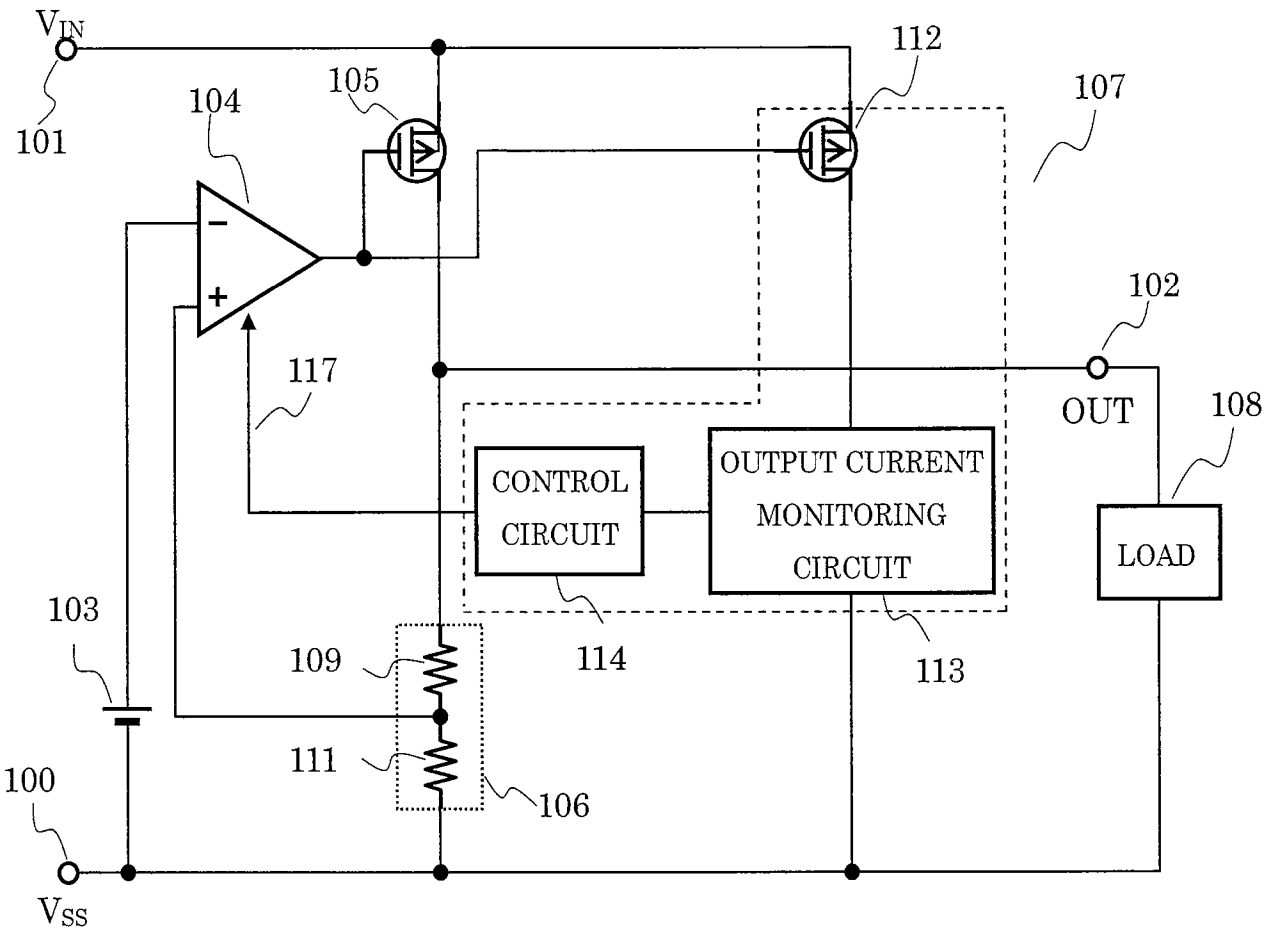
FIG. 6 PRIOR ART
FIG. 6 is a circuit diagram illustrating a conventional voltage regulator including an output current detection circuit.

The voltage detection circuit 301 illustrated in FIG. 5 includes depletion mode NMOS transistors 501, 502, 503, and 504, a capacitor 505, and a resistor 506. An input terminal 510 is connected to the output terminal 102 of the voltage regulator, and an output terminal 511 is connected to the gate of the detection transistor 112.

Note that, in the circuit of FIG. 3, the same effect can be obtained even without the capacitor 152.

Further, the pre-driver 201 which is current-mirror connected to the detection transistor 112 may be added in parallel to the output transistor 105.

Third Embodiment

Figure 4:
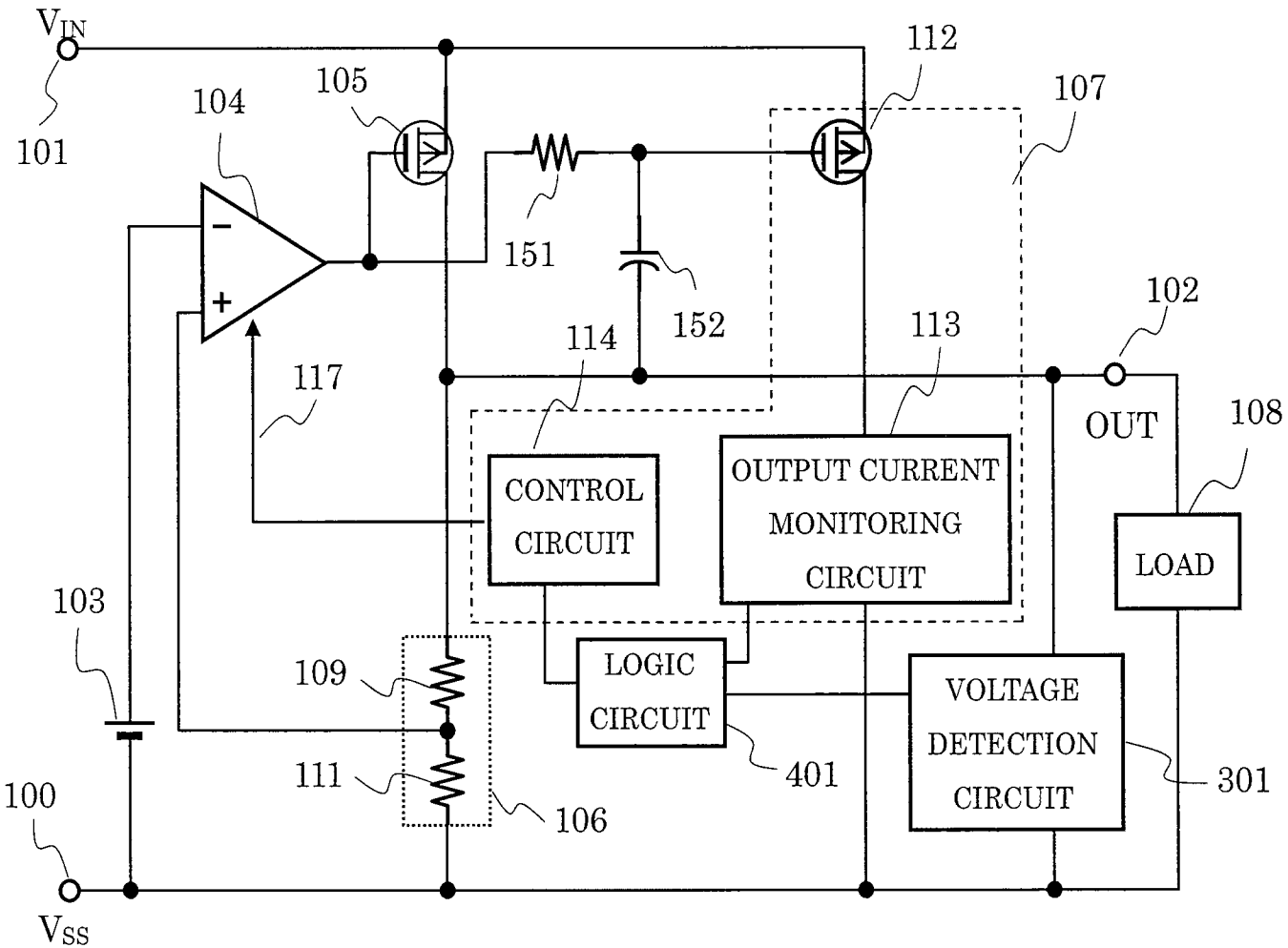
FIG. 4 is a circuit diagram illustrating a voltage regulator including an output current detection circuit according to a third embodiment of the present invention.

FIG. 4 is a circuit diagram illustrating a voltage regulator including an output current detection circuit according to a third embodiment of the present invention. The voltage regulator in this embodiment is obtained by modifying the circuit in the second embodiment so that the output of the voltage detection circuit 301 is input to the control circuit 114 via a logic circuit 401 (for example, OR circuit).

Next, the operation of the voltage regulator in the third embodiment is described.

When a load 108 fluctuates from a light load to a heavy load, in response to the fluctuation in output voltage of the output terminal 102, the voltage detection circuit 301 outputs a signal for increasing a bias current of the differential amplifier circuit 104 to the control circuit 114 via the logic circuit 401. The logic circuit 401 performs OR operation (in the case of OR circuit) on the signal of the voltage detection circuit 301 and the output voltage of the output current monitoring circuit 113, and outputs a signal to the control circuit 114. As a result, the bias current of the differential amplifier circuit 104 can be increased via the control circuit 114. In this way, the bias current of the differential amplifier circuit 104 can be increased faster than in the other embodiments, and hence the transient response characteristics can be improved more.

Note that, in the circuit of FIG. 4, the same effect can be obtained even without the resistor 151 and the capacitor 152.

Further, the pre-driver 201 which is current-mirror connected to the detection transistor 112 may be added in parallel to the output transistor 105.

What is claimed is:

1. A voltage regulator for outputting a desired output voltage to an output terminal, comprising:

a differential amplifier circuit for amplifying a difference between a reference voltage and a voltage based on an output voltage;

an output transistor controlled by the differential amplifier circuit;

a current detection circuit comprising:

a detection transistor including a gate connected to an output terminal of the differential amplifier circuit;

an output current monitoring circuit connected to a drain of the detection transistor; and a control circuit connected to an output terminal of the output current monitoring circuit, the current detection circuit being configured to detect an output current of the output terminal of the voltage regulator and control a bias current of the differential amplifier circuit;

a resistive element connected between the output terminal of the differential amplifier circuit and the gate of the detection transistor; and a capacitive element connected between the output terminal of the voltage regulator and the gate of the detection transistor.

2. A voltage regulator according to claim 1, further comprising a transistor as a pre-driver, which includes a gate connected to the gate of the detection transistor, a source connected to a source of the output transistor, and a drain connected to a drain of the output transistor.

3. A voltage regulator for outputting a desired output voltage to an output terminal, comprising:

a differential amplifier circuit for amplifying a difference between a reference voltage and a voltage based on an output voltage;

an output transistor controlled by the differential amplifier circuit;

a current detection circuit comprising:

a detection transistor including a gate connected to an output terminal of the differential amplifier circuit;

an output current monitoring circuit connected to a drain of the detection transistor; and a control circuit connected to an output terminal of the output current monitoring circuit, the current detection circuit being configured to detect an output current of the output terminal of the voltage regulator and control a bias current of the differential amplifier circuit;

a resistive element connected between the output terminal of the differential amplifier circuit and the gate of the detection transistor; and a voltage detection circuit connected between the output terminal of the voltage regulator and a ground terminal, for detecting a decrease in voltage of the output terminal of the voltage regulator and controlling a voltage of the gate of the detection transistor to a ground voltage.

4. A voltage regulator according to claim 3, further comprising a transistor as a pre-driver, which includes a gate connected to the gate of the detection transistor, a source connected to a source of the output transistor, and a drain connected to a drain of the output transistor.

5. A voltage regulator for outputting a desired output voltage to an output terminal, comprising:

a differential amplifier circuit for amplifying a difference between a reference voltage and a voltage based on an output voltage;

an output transistor controlled by the differential amplifier circuit;

a current detection circuit comprising:

a detection transistor including a gate connected to an output terminal of the differential amplifier circuit;

an output current monitoring circuit connected to a drain of the detection transistor; and a control circuit connected to an output terminal of the output current monitoring circuit, the current detection circuit being configured to detect an output current of the output terminal of the voltage regulator and control a bias current of the differential amplifier circuit; and a voltage detection circuit connected between the output terminal of the voltage regulator and a ground terminal, for detecting a decrease in voltage of the output terminal of the voltage regulator and outputting a detection signal to the control circuit.

6. A voltage regulator according to claim 5, further comprising:

a resistive element connected between the output terminal of the differential amplifier circuit and the gate of the detection transistor;

a capacitive element connected between the output terminal of the voltage regulator and the gate of the detection transistor; and a transistor as a pre-driver, which includes a gate connected to a gate of the detection transistor, a source connected to a source of the output transistor, and a drain connected to a drain of the output transistor.

* * * * *